United States Patent [19]

Laughton

[11] 4,039,079

[45] Aug. 2, 1977

[54] DISPLAY PACKS FOR BRUSHES

[75] Inventor: Malcolm Laughton, Birmingham, England

[73] Assignee: H. Goodman & Sons, Inc., Kearny, N.J.

[21] Appl. No.: 647,137

[22] Filed: Jan. 7, 1976

[30] Foreign Application Priority Data

Jan. 11, 1975 United Kingdom ..... 1218/75

[51] Int. Cl.[2] ..... B65D 73/00

[52] U.S. Cl. ..... 206/461; 206/820; 206/361

[58] Field of Search ..... 206/461–469, 206/361, 362.3, 820, 470

[56] References Cited

U.S. PATENT DOCUMENTS

| | | | |
|---|---|---|---|
| 2,885,071 | 5/1959 | Rodnon | 206/820 |
| 3,004,661 | 10/1961 | Schumann | 206/361 |

*Primary Examiner*—George T. Hall

[57] ABSTRACT

A display pack for the display and sale of an article or articles of mechandise such as a hair brush or comb which exposes a part of the article so that its quality can be tested by a prospective purchaser yet contains the article well enough to make pilfering from the card difficult. In one type of pack an article is held on a backing sheet by two flanged, transparent cover elements mounted by their flanges on the backing sheet and covering opposite ends of the article leaving the part between exposed. In another type of pack a single cover element encloses, for example, the handle of a hair brush, and another part of the article, for example the back of the brush, is held by an opening in the backing sheet. The cover elements can be made in pairs by vacuum forming sheet material with a raised central portion surrounded by a continuous peripheral flange and cutting the elements apart across the raised portion.

16 Claims, 13 Drawing Figures

DISPLAY PACKS FOR BRUSHES

Figure 1:
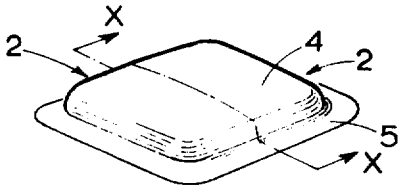

This invention relates to display packs in which articles of merchandise can be displayed and sold.

One kind of display pack, usually known as a blister pack, has a cardboard backing sheet, a hollow transparent flanged cover containing the goods within the hollow and secured to the backing sheet by the flange. The backing sheet is usually printed with information relating to the goods. Although an article to be sold can be seen through the cover the customer cannot feel it to assess its nature or quality. The pack is difficult to open without a cutting instrument. This is a nuisance to the purchaser.

The present invention consists in a display pack containing at least one article of merchandise and comprising a backing sheet, at least one flanged, transparent open-sided cover element, and co-operating securing means on the backing sheet, the cover element being mounted by its flanges on the backing sheet with its open side directed across the main part of the backing sheet and receiving a part of the article which is made captive on the backing sheet by the cover element together with the co-operating securing means, and a portion of the article being exposed from the pack so that it can be felt.

The co-operating securing means may comprise a further flanged, transparent, open-sided cover element mounted by its flange on the backing sheet and spaced from the one cover element and with its open side directed to receive another part of the article. Alternatively the co-operating securing means may be the marginal portion of the backing sheet around an opening therein and shaped to engage the article.

The cover element and co-operating securing means should extend far enought to secure the article or articles to the card against pilferage or accidental dislodgement. Sufficient of the article may still be exposed for the customer to be able to feel it and the purchaser can remove the pack quite easily by tearing through the backing sheet. Less material is needed to make the cover element or spaced cover elements than for an overall cover.

Two cover elements mounted with their open sides directly confronting will often be sufficient to secure an article. For example an elongated article. such as a hairbrush or comb may be secured by cover elements embracing opposite ends. Two or more elongated articles may similarly be held side by side in a single pack by two cover elements each receiving the ends of the articles in a large pocket or a series of smaller ones. A triangular or square article may be held by cover elements over each corner and more irregularly shaped articles may be held by cover elements of appropriate shape to embrace salient portions of the article.

Cover elements may conveniently be formed from flat sheet material by vacuum or positive gaseous pressure in a mould or form, the flange being formed by material gripped between parts of the mold or form. A continous peripheral flange is necessarily produced. The open side of the cover elements does not have a peripheral flange and it is convenient to produce two or more cover elements in one piece and then cut them apart across the hollow.

According to this aspect the invention consists in a method of manufacturing a display pack comprising forming cover elements from sheet transparent plastics material as a unit having a continuous peripheral flange around a central raised portion; cutting the cover elements apart so forming unflanged open sides at the cut; assembling at least one of the cover elements, at least one article of merchandise and a backing sheet having co-operating securing means, engaging the article with the co-operating securing means, fitting the raised portion of the cover element over a part of the article with its flange in contact with the backing sheet, and fastening the pack by securing the flange to the backing sheet.

Unless material is cut away between the elements the open sides of the cover elements are similar. If this unduly restricts the shape or size of the open side, the similar cover elements or two or more packs may be made from a symmetrically shaped unit formed with a continous peripheral flange and then cut apart. For example, though it may be convenient to make the cover elements for embracing the ends of a comb from an elongated unit with a continous peripheral flange and then simple cut the unit across the middle to separate the two cover elements, this would not do for a tail comb or a hairbrush. For such articles the opening of the cover element to receive the larger end of the article must be much bigger than that for the handle end. It is then usually more economical to make the small cover elements of two packs in one unit and the larger cover elements in another unit. Each unit is symmetrical about the line of cut.

The backing sheet is conveniently of cardboard but could be of other relatively stiff material. It will usually be printed with information about the article. The flanges of the cover elements may be secured to the face of the backing sheet by a heat sealing process but an adhesive might be used instead.

In another form of the invention the backing sheets for several elongated packs are printed side-by-side on one piece of card. The cover elements for the one end of each pack are left joined together in one strip and those for the other end in another strip. The length of each strip is equal to the combined widths of the backing sheets included in the piece of card and the number and spacing of the cover elements is appropriate to the number of backing sheets in the piece of card. The articles to be packed are assembled on the piece of card and the assembly of packs completed by securing the strips to the card by one or other of the means previously described. Finally the individual packs are cut apart.

The strips of cover elements may be made individually or the strips containing both cover elements of each pack may be made together and then the two strips cut apart or the strips of identical cover elements for two pieces of card may be made together and then cut apart in a manner similar to that described above for the manufacture of single packs.

This form of the invention has the advantage of avoiding the handling of small individual cover elements and enables several packs to be assembled in little, if any, more time than that necessary for a single pack.

Figure 2:
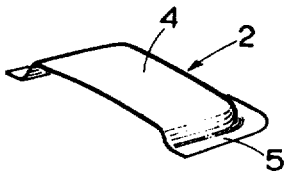
Figure 3:
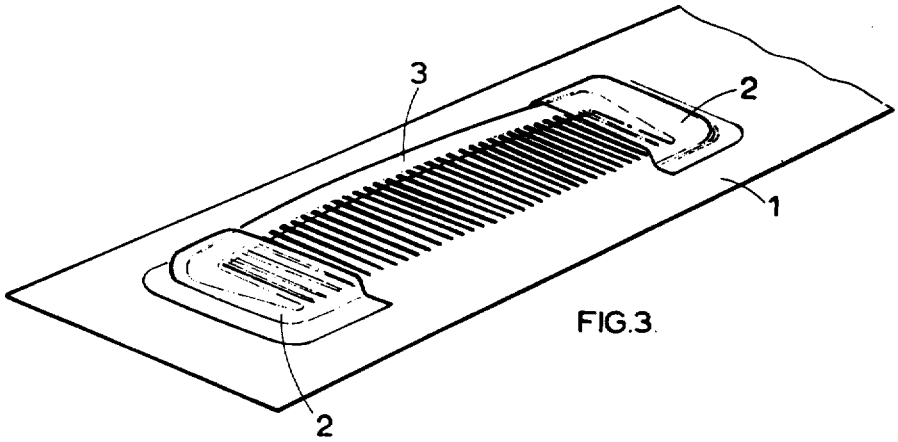
Figure 4:
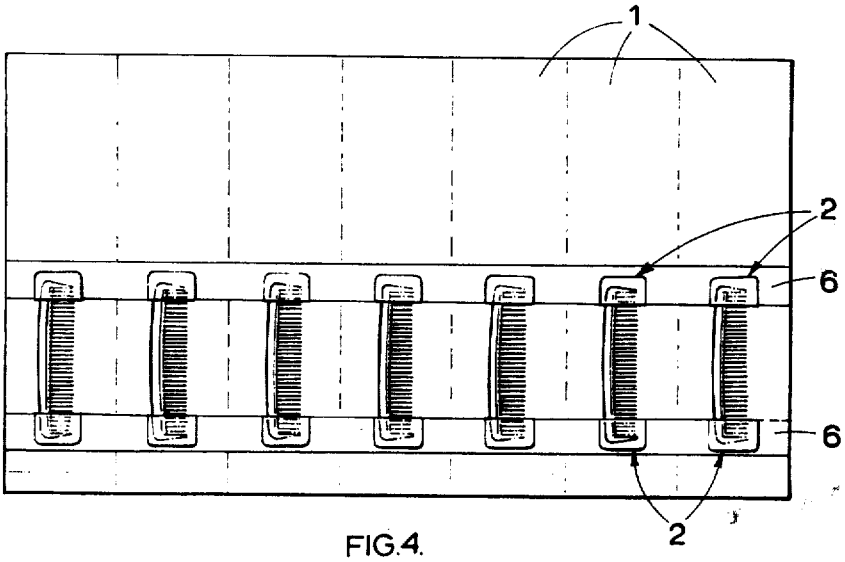
Figure 5:
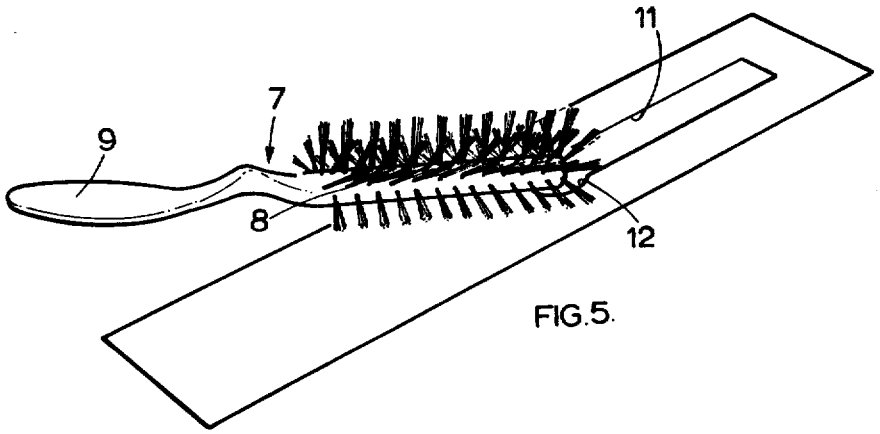
Figure 6:
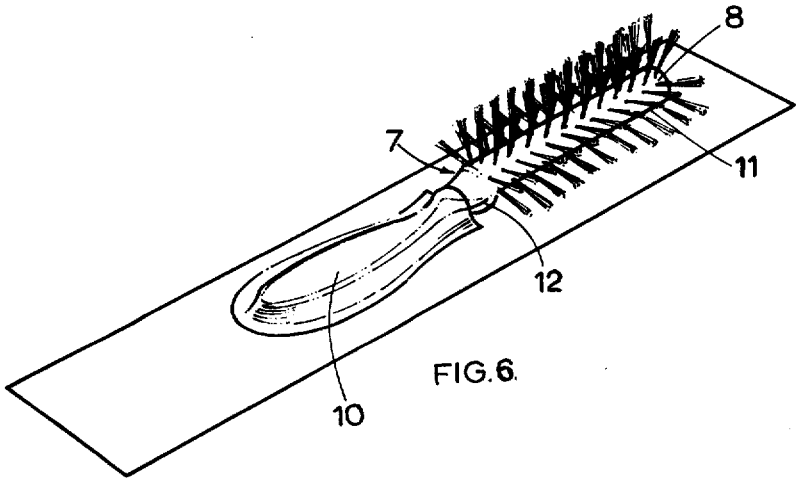
Figure 7:
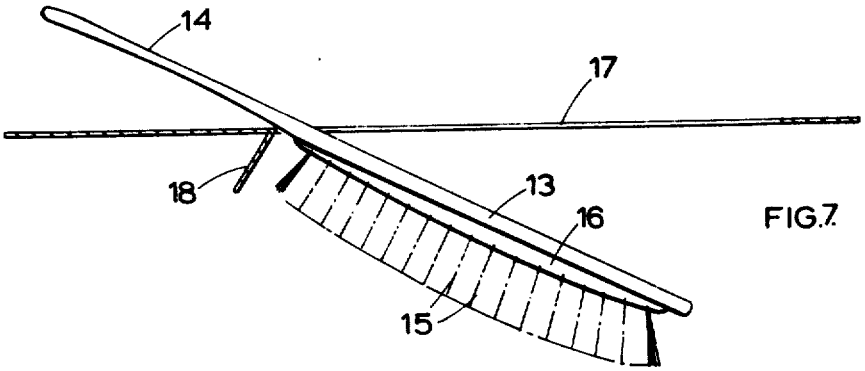
Figure 8:
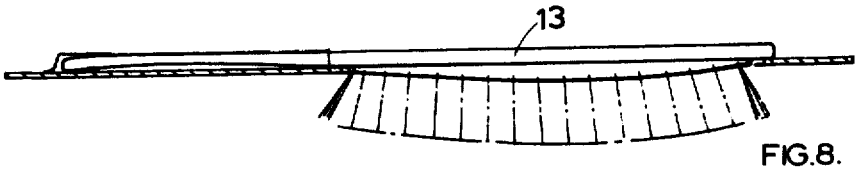
Figure 9:
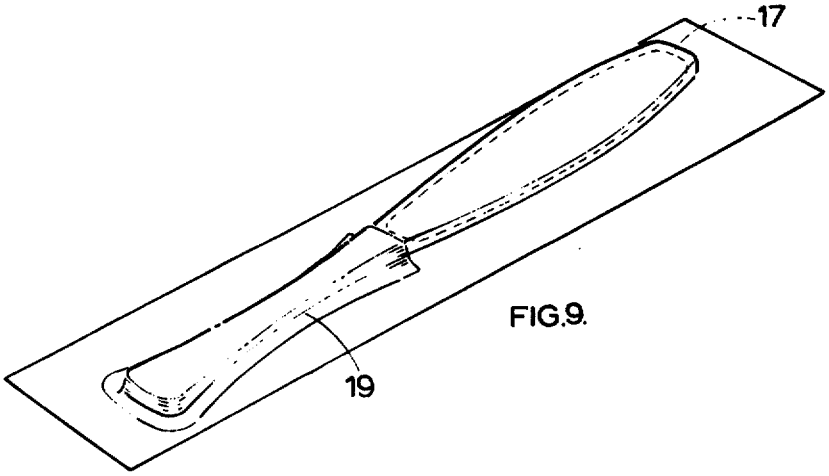
Figure 10:
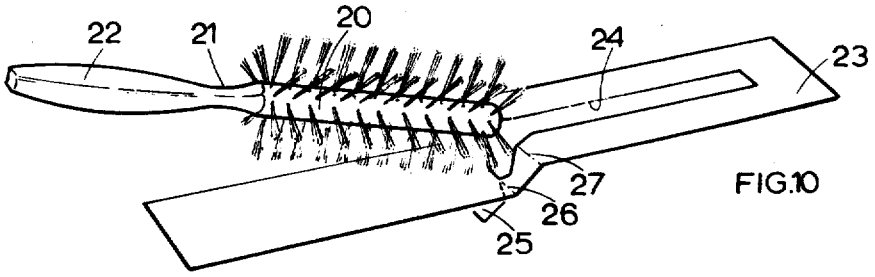
Figure 11:
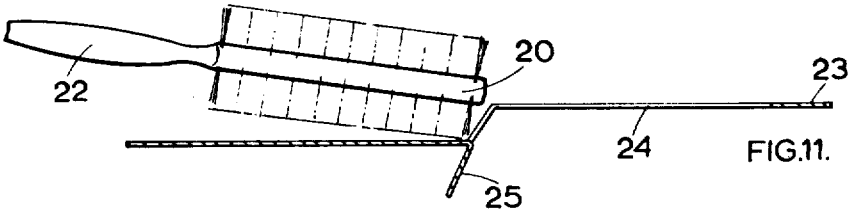
Figure 12:
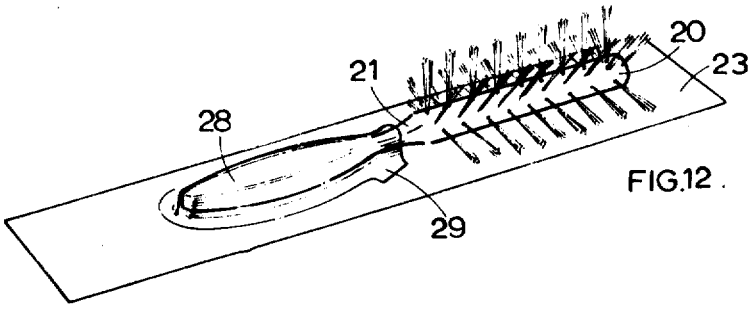
Figure 13:
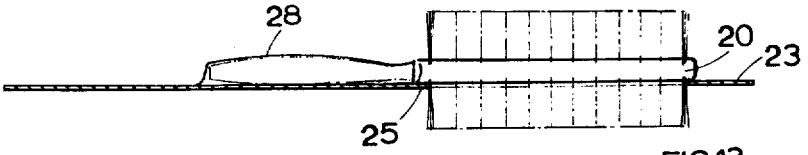

The invention will now be described, by way of example only, with reference to the accompanying drawings in which:

FIGS. 1 and 2 are similar perspective views showing stages in the manufacture of cover elements for packs according to the invention, FIG. 3 is a perspective view of a complete pack, FIG. 4 is a plan view illustrating the simultaneous production of several packs according to FIG. 3, FIGS. 5 and 6 are perspective views of another form of pack according to the invention, FIGS. 7 and 8 are longitudinal sections and FIG. 9 is a perspective view of a further form of pack according to the invention, and FIGS. 10 and 12 are perspective views and FIGS. 11 and 13 are longitudinal sections of still another pack according to the invention.

The pack of FIGS. 1 to 3 comprises a cardboard backing sheet 1 and two similar transparent, flanged cover elements 2 embracing opposite end parts of an elongated article of merchandise such as a comb 3. The cover elements 2 as illustrated in FIG. 1 are made as a unit from a blank of transparent sheet plastics formed in a mould or form into a shape having a central raised hollow part 4 and a surrounding peripheral flange 5. The marginal portion of the blank forming the peripheral flange 5 is gripped between parts of the mould or form and the central raised hollow part 4 is caused, by vacuum or positive gaseous pressure and the application of heat, to conform to the shape of a cavity in the mould or form. By cutting the moulding through the middle as indicated by line X—X of FIG. 1, two similar cover elements as shown in FIG. 2 are produced each having an open side formed at the line of cut. The two cover elements are assembled with the comb 3 or other article on the backing sheet. The open side of each cover element is directed across the main part of the backing sheet and receives an end of the comb. To complete the assembly the flanges 5 of the cover elements are heat sealed to the backing sheet, fastening the comb in the pack, but as the cover elements 2 are spaced apart the teeth of the comb are left exposed so that a customer can feel them before buying.

Instead of being assembled individually, packs similar to that of FIG. 3 may be made in multiples as shown in FIG. 4. The backing sheets 1 for several elongated packs are printed side-by-side on one piece of card. The cover elements 2 for all the packs are made together in a single continuous strip and then slit down in the middle to form two strips 6. The length of each strip is equal to the combined widths of the backing sheets included in the piece of card and the number and spacing of the cover elements is appropriate to the number of backing sheets in the piece of card. The strips 6 are laid hollow side up in a jig, the combs or other articles laid on them and the piece of card laid on top. Heat is applied to the flange parts of the strips 6 in contact with the card to heat seal them to the card. Finally the individual packs are cut apart.

The pack of FIGS. 5 and 6 is for a brush 7 having rows of tufts along the curved side of a D-section shank 8 which continues through a narrow junction into a bulbous handle 9. A flangd transparent cover element 10 shaped to fit the bulbous handle is made by the method already described for FIGS. 1 and 2. Only one cover element is required for each pack but the cover elements are made in pairs and cut apart to form the open side through which the shank 8 extends. An elongated opening 11 is pierced in the backing sheet. The main part of the opening 11 is parallel sided and slightly narrower than the widest part of the D-section of the shank. The end 12 of the opening 11 near the middle of the backing sheet is enlarged and rounded.

On assembly the free end of the shank is entered in the enlarged end 12 as indicated in FIG. 5 and pushed along the opening 11 the edges of which embrace the edges of the shank and hold the shank on the backing sheet. The cover element 10 is then fitted over the handle 9 and heat sealed to the backing sheet. Near its open side the cover elements is narrowed to correspond to the narrow junction so preventing withdrawal of the bulbous part through the open side. The opening 11 forms cooperating securing means assisting the cover element 10 to hold the brush captive on the backing sheet. The brush can be removed only by breaking the pack but the tufts are exposed on the front of the backing sheet while the pack is on display.

The pack shown in FIGS 7, 8 and 9 is for a brush with flat back 13. The side edges of the back 13 are convexly curved and extend into a handle 14 whose side edges are concave curves and which is bulbous at the free end. Tufts 15 are arranged in longitudinal rows in a convex pad 16 on the front of the brush. The tufts in the outside rows are inclined outwards over the side edges.

The backing sheet has an opening 17 complementary to the shape of the back but slightly smaller. At the end of the opening 17 near the middle of the card a flap 18 is slit from the backing sheet except at the end remote from the opening where it remains attached to the backing sheet to form a hinge. The flap 18 is as wide as the free end of the handle 14.

Insertion of the brush into the backing sheet is shown in FIG. 7 in which the backing sheet is face upwards and the flap 18 hinged downwards. The handle 14 of the brush is inserted from the rear as far as it will go through the aperture left by hinging the flap 18. The back of the brush is swung upwards and eased through the opening 17 the edges of which flex slightly to allow it to pass. The brush is slid to the right as viewed in FIGS. 7 and 8 until the end of the back overlaps the far end of the opening 17. The flap 18 is then returned to its original position and lies under the junction of the back 13 and handle 14. The edges of the opening 17 including the free edge o the flap 18, fit closely around the outside tufts where they meet the pad and hold the back of the brush close against the face of the backing sheet.

The handle 14 is enclosed by a flanged, transparent, sheet plastics cover element 19. The cover elements are made in end-to-end pairs as previously described. They are cut apart along the transverse axis of symmetry to form the open side of the cover element. The flange of the cover element is heat sealed to the face of the backing sheet and the ends of the flange near the open side covers the slits at the edges of the flap 18 which is thereby held in the locking position. A waisted part of the cover element fits closely the narrowest part of the handle 14 and the bulbous free end of the handle prevents withdrawal of the handle through the open side of the cover element. The brush is securely held in the pack but the tufts are exposed at the rear of the backing sheet.

In a modification (not illustrated) the brush has a back which is rather more pointed at the free end than the brush shown in FIGS. 7, 8 and 9. In side elevation the bulbous handle and back make a flattened S curve the convex side of the handle being on the same side as the tufts. The backing sheet has a simple opening complementary to the back which because it is curved and tapers to the free end can be inserted into the opening from the front of the backing sheet and slid forward so that the pointed end underlies the marginal portion around the corresponding end of the opening and the junction of the back and handle rests on the other end of the opening. This position is maintained by a cover element similar to that of FIGS. 5 and 6 but modified to suit the shape of the handle of the brush in this pack. In this modification the tufts are exposed on the front of the backing sheet.

The brush shown in FIGS. 10 to 13 has a cylindrical shank 20, with longitudinal rows of tufts spaced around the full circumference of the cylinder from which the tufts extend radially. The shank 20 at one end continues through a neck 21 into a bulbous handle 22. A backing sheet 23 has a parallel-sided opening 24 extending from the middle of the length of the backing sheet 23 towards one end. Near the middle of the backing sheet the sides of the opening 24 are continued by slits at first diverging and then coverging again to form a flap 25 which remains attached to the main body of the backing sheet at the end remote from the opening. A crease 26 extends across the full width of the backing sheet at the root of the flap 25 providing it with a hinge. A further crease 27 parallel to the crease 26 is made in the backing sheet only, nearer the free end of the flap. To fit the brush into the opening 24, the flap 25 is opened and the backing sheet 23 is bent at the creases 26 and 27 in opposite directions to form a step as shown in FIGS. 10 and 11. The open flap 25 forms a widened mouth of the opening 24 for insertion of the free end of the brush. Two or more of the longitudinal rows of tufts pass through the mouth of the rear of the backing sheet but the main part of the shank 20 remains on the front of the backing sheet. The parallel sides of the opening 24 fit into the angles formed where the shank receives the outside rows of those tufts which project to the rear of the backing sheet and held the tufted part of the brush closely to the adjacent part of the backing sheet. When the shank has been pushed to the far end of the opening 24 the flap 25 is closed and the step in the backing sheet flattened.

A cover element 28 shaped to suit the bulbous handle 22 but otherwise similar, and made in a similar way, to the cover elements 10 and 19 of the previous embodiments is heat sealed to the face of the backing sheet. As in the embodiment of FIGS. 7 and 9 the ends 29 of the flange near the neck 21 overlie the slits forming the flap 25 and hold the flap shut and the step flat.

I claim:

1. A display pack comprising a stiff backing sheet bearing a brush having a handle and having a bristle portion including a shank from which bristles project, and a cover element having a portion defining an open-sided cavity and having flanges, and cooperating securing means on the backing sheet separate and distinct from said cove element, the cove element being mounted by its flanges on the backing sheet with its open side directed across the main part of the backing sheet and receiving said handle, the brush being made captive on the backing sheet by the cover element together with the cooperating securing means, and the bristles being exposed from the pack so that they can be felt.

2. A display pack according to claim 1 wherein the handle is bulbous and the cover element encloses the bulbous part sufficiently to prevent withdrawal of the bulbous part.

3. A display pack according to claim 1 wherein the cooperating securing means is the marginal portion of the backing sheet around an opening therein, said cooperating securing means cooperating with said bristle portion of the brush.

4. A display pack according to claim 3 having a hinged flap slit from the backing sheet and with a free edge forming in the closed position a part of the outline of the opening, in the open position the flap affording an enlargement of the opening faciliating insertion of the brush therein.

5. A display pack according to claim 4 wherein the flange of the cover element overlaps the slit between the flap and the marginal portions of the backing sheet to both of which it is secured.

6. A display pack according to claim 1 wherein the co-operating securing means is the marginal portion of the backing sheet around an opening therein, the backing sheet having a hinged flap slit from the backing sheet and with a free edge forming in the closed position a part of the outline of the opening, parallel creases being formed in the backing sheet in the region of the flap enabling the backing sheet to be folded into step form, the aperture exposed by the flap forming an entrance to the opening in the face of the step for insertion of the brush.

7. A display pack according to claim 6 wherein the flange of the cover element overlaps the slit between the flap and the marginal portions of the backing sheet to both of which it is secured.

8. A display pack according to claim 1, said shank being of D-section with tufts the bristles on the convex side thereof, many of the bristles overlying one face of the backing sheet, and said handle being bulbous so as to have an enlarged portion and having a narrower portion between said enlarged portion and the shank, the cooperating securing means being the marginal portion of the backing sheet around an opening therein, the main part of the opening being parallel sided and slightly narrower than the widest part of the D-section of the shank, said widest portion being disposed at the face of said backing sheet opposite to said one face thereof, one end of the opening being enlarged to allow the free end of the shank to enter the opening so that the edges thereof embrace the edges of the shank, and the cover element fitting said narrower portion of the bulbous handle closely so as to prevent withdrawal of the handle from the cover element.

9. A display pack according to claim 1, said shank being a flat back, many of said bristles being inclined outward over the edge of the back and said handle extending from the edge of the back and having an enlarged portion remote from said back and having a narrower portion nearer to said back, the cooperating securing means being the marginal portion of the backing sheet around an opening therein, and the backing sheet having a hinged flap slit therefrom and with a free edge forming in the closed position a part of the outline of the opening, in the open position the flap affording an entrance through which the handle of the brush can be inserted from the rear of the backing sheet and allowing the back of the brush to be passed through the opening and moved to a position in which the flap can be closed, the edge of the back overlying one face of the backing sheet along marginal portions of the backing sheet at the opening and many of said bristles overlying the opposite face of said backing sheet and constraining said back against said one face of the backing sheet; the flange of the cover element overlapping the slit between the flap and the adjacent portions of the backing sheet to both of which it is secured and the cover element fitting the narrower portion of the handle closely so as to prevent withdrawal of the handle from the cover element.

10. A display pack according to claim 1, said shank being a back pointed at one end remote from said handle, said back being longitudinally concave on one side and bearing said bristles on said concave side, and the handle being oppositely curved, the cooperating securing means being the marginal portion of the backing sheet around an opening therein complementary in shape to the back of the brush, the back entering the opening from the front of the backing sheet with its pointed end underlying the marginal portion around the corresponding end of the opening and the junction of the back and handle resting on the backing sheet at the other end of the opening, and the cover element fitting the handle closely so as to prevent withdrawal of the handle from the cover element.

11. A display pack according to claim 1, said shank being cylindrical and bearing said bristles in longitudinal rows of tufts spaced around its curved surface and extending radially thereform, said cooperating securing means being the marginal portion of the backing sheet around a parallel-sided opening therein, and the backing sheet having a hinged flap slit therefrom and with a free edge forming in the closed position an end of the opening, a transverse crease formed in the backing sheet spaced from the hinge of the flap and formed nearer to the opening than the hinge, thereby enabling the backing sheet to be bent for providing a widened mouth to the opening for the insertion of the shank end of the brush and to allow some of the rows of tufts to pass through to the rear of the backing sheet, the edges of the opening engaging the angle formed between the shank and the outside rows of tufts, the flange of the cover element overlapping said crease and the slit between the flap and the adjacent portions of the backing sheet and secured thereto to hold the backing sheet flattened and the flap closed.

12. A display pack including a stiff backing sheet, a brush having a handle and having a bristle portion including a body extending from the handle and bristles projecting from said body, and a cover element over said handle, said cover element having flanges secured to said backing sheet, said handle having an enlarged portion and having a narrower portion between said body and said enlarged portion, and said cover element fitting said narrower portion of the handle to prevent removal of the brush from the backing sheet, the bristles being exposed from the pack so that they can be felt.

13. A display pack according to claim 12, wherein the backing sheet has an opening formed therein, said bristle portion of the brush projecting through said opening so as to have portions thereof disposed at opposite faces of the backing sheet and the margins of said opening in the backing sheet being disposed close to opposite sides of said bristle portion and close to the end thereof opposite said handle for constraining said bristle portion of the brush against movement laterally and endwise away from the cover element and thus forming at least part of said cooperating securing means.

14. A display pack according to claim 12, wherein the backing sheet has an opening formed therein, margins of the backing sheet which define the opening extending along the bristle portion of the brush, portions of said bristle portion of the brush being disposed at opposite faces of the backing sheet along said margins for complementing said cover element in locating the brush on the backing sheet.

15. A display pack according to claim 14 wherein some of said bristles overlie one face of said backing sheet and portions of said body overlie the opposite face of said backing sheet along said margins.

16. A display pack according to claim 14 wherein said backing sheet is confined between first and second groups of bristles overlying opposite faces of the backing sheet.

* * * * *